United States Patent [19]

Cornish et al.

[11] Patent Number: 4,487,547

[45] Date of Patent: Dec. 11, 1984

[54] METHOD FOR RANDOM CAR TRAIN POSITIONING

[75] Inventors: James E. Cornish, North Olmsted; Edward T. Manning, Jr., Bay Village, both of Ohio

[73] Assignee: Dravo Corporation, Pittsburgh, Pa.

[21] Appl. No.: 389,249

[22] Filed: Jun. 17, 1982

[51] Int. Cl.[3] ..... B65G 67/50

[52] U.S. Cl. ..... 414/786; 104/162; 104/176; 414/359

[58] Field of Search ..... 104/173 R, 176, 162; 213/224; 414/359–361, 367, 371, 372, 786

[56] References Cited

U.S. PATENT DOCUMENTS

| | | | |
|---|---|---|---|
| Re. 27,300 | 2/1972 | Ludwig | 104/176 |
| 1,125,110 | 1/1915 | Jones | 104/176 |
| 1,162,760 | 12/1915 | Fickinger | 104/176 |
| 1,887,667 | 11/1932 | Wheeler | 104/173 R X |
| 2,199,470 | 5/1940 | Taylor | 104/176 X |
| 3,169,490 | 2/1965 | Saxonmeyer | 104/176 |
| 3,450,059 | 6/1969 | Fishburne et al. | 104/176 |
| 3,942,451 | 3/1976 | Modliszewski | 104/176 |
| 3,987,735 | 10/1976 | Lofink | 104/176 |

OTHER PUBLICATIONS

"Train Positioner General Arrangement", McDowell-Wellman Engineering Co., Drawing No. 124186, 2-1-5-1968.

*Primary Examiner*—Randolph Reese

*Attorney, Agent, or Firm*—Parmelee, Miller, Welsh & Kratz

[57] ABSTRACT

A car positioning device for dumping of random cars in a rotary car dumper, and a method for directly positioning cars within a rotary dumper, where the car positioning device, movable on a trackway parallel to a track portion carrying railroad cars, has a carriage base and a pivoted car positioning arm thereon, the car positioning arm being L-shaped with a long section extending parallel to the trackway and a short section carrying a coupling apparatus, transverse the track portion, such that the long section extends beyond the carriage and beyond the guideway for the carriage, with the short section of the arm positionable within the car dumping apparatus to directly position a car within the confines of the dumper.

4 Claims, 6 Drawing Figures

METHOD FOR RANDOM CAR TRAIN POSITIONING

BACKGROUND OF THE INVENTION

The present invention relates to a railroad car positioning device for use in moving one or more railroad cars along a track towards a railroad car dumping apparatus, and a method for positioning railroad cars for dumping. Such positioning devices are generally adapted to travel along tracks that are parallel to the railroad tracks upon which the railroad cars move and have an arm which may be coupled to one railroad car or simultaneously coupled to two spaced railraod cars, and move the car or cars into a position within the dumping apparatus.

Car positioning devices have been provided which may be used in connection with "unit train" type unloading where the cars remain coupled together during the dumping cycle, using rotary couplers on the cars, or with random railroad cars, where cars, or pairs of cars, are separated from adjacent cars during the dumping cycle. Devices have also been provided, for example, in U.S. Pat. No. 3,942,451, which are usable in connection with both a unit train and random car dumping cycle. In U.S. Pat. No. 3,942,451, a train positioner has an L-shaped positioner arm having "E" type couplers which can swing into position to extend in either direction from the arm so that the positioner can be used to push or pull cars in either direction along the tracks. The arm, however, cannot be extended far enough towards the dumper so as to directly position a car within the dumper for a dumping cycle. This requires that an additional car must be used to push the car to be dumped into position in the dumping apparatus. Also, although the couplers on the arm can be uncoupled automatically, a workman must uncouple the pusher car from the car to be dumped, thus requiring an additional workman.

In U.S. Pat. No. 3,169,490, a train positioner is described which is mounted on a transfer table. A hook on the end of an extended support, pivotally mounted on the positioner arm to extend in either direction, can be coupled to a car on a selected track to pull a car onto the table. This positioner is also suggested for use in positioning and removing cars from an unloader.

A need exists, however, for a train positioning device and car positioning method which, in addition to moving the car or cars towards a dumper, can directly position the cars in the dumper for the dumping cycle.

BRIEF SUMMARY OF THE INVENTION

The car positioning device of the present invention comprises an apparatus for moving at least one railroad car along a track portion between a restraining means for a train and a rotary car dumper, having a carriage disposed for movement parallel to the track portion and means for guiding the carriage therealong, a car positioner arm with a distal extremity positionable between a pair of coupled railroad cars and means for positioning the arm into and out of car pushing position, wherein the car positioner arm is of L-shaped design with the long section thereof pivotally connected to the carriage and extending in a direction along the track portion, beyond the carriage and the means for guiding the carriage at its furthest point of travel theralong, such that the short section of the arm is capable of precisely positioning a car within the confines of the car dumper. Use of the car positioner device provides a method whereby the car positioning device is usable for moving a first car along the trackway and into the dumper while moving another car into the space between a restraining means and the dumper, such that the first car may be precisely positioned within the confines of the dumper without the need of rolling the cars into the dumper or using a separate car charging device for such positioning.

DETAILED DESCRIPTION

Figure 1:
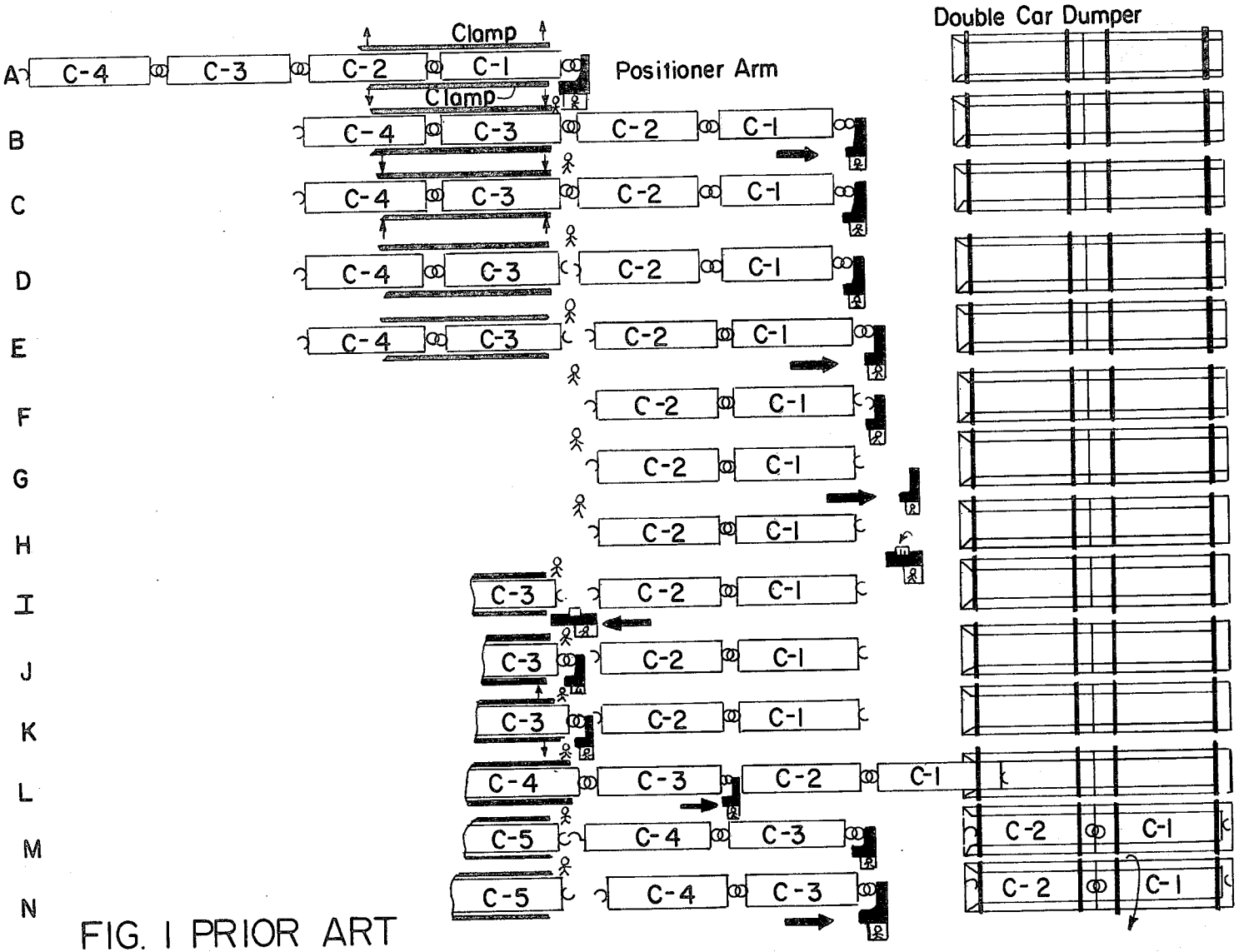
FIG. 1 PRIOR ART
FIG. 1 schematically illustrates a prior art method for positioning cars in a rotary dumper wherein the cars are rolled into the dumper and stopped by retarders for positioning therein.
Figures 2, 3:
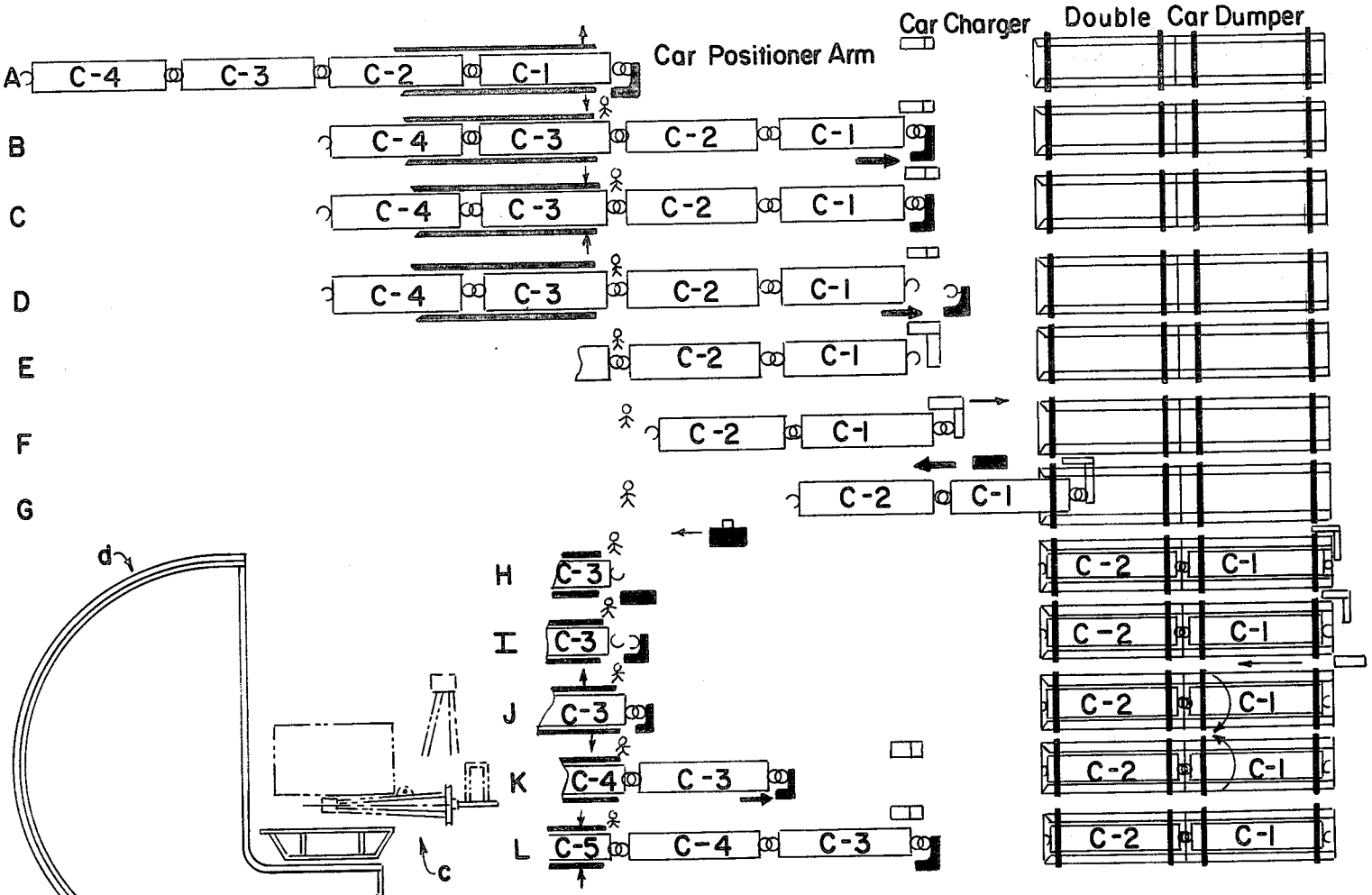
FIG. 2 PRIOR ART
FIG. 3 PRIOR ART
FIG. 2 schematically illustrates a further prior art method for positioning cars in a rotary dumper where the dumper is of C-shaped design and a separate car charging device is used to position the cars therein.
FIG. 3 schematically illustrates an end view of a C-shaped dumper required for use with the method of FIG. 2.

The unloading of random sized cars which are not equipped with rotary couplers has traditionally been accomplished by the schematic operations described in FIGS. 1 and 2, both of which operations require the use of two workers.

Referring to FIG. 1, the unloading of random sized cars in pairs, with a pair of cars dumped simultaneously, is illustrated wherein clamps are provided to hold cars prior to movement between an uncoupling step and towards a double car dumper, with a workman needed for such uncoupling, as well as a car positioner device which travels alongside and parallel to the tracks, having a positioner arm with a workman required for operation of the positioner. In the sequence illustrated in Steps A-N, the following steps are carried out. At the start of the sequence, four cars C-1 to C-4 have been moved such that cars C-1 and C-2 are held by the clamps. In step A, the clamps are moved so as to release their grip on the cars with the car positioning device coupled to the lead coupler of car C-1. Step B shows movement of the cars towards the dumper by the car positioning device and its operator, while the uncoupler worker remains adjacent the clamp area. The clamps are then activated to restrain cars C-3 and C-4 in Step C. In Step D, the uncoupler worker manually uncouples cars C-1 and C-2 from restrained cars C-3 and C-4, while the car positioner operator remains with the car positioning device. Step E then shows the car positioner operator operating the car positioner device to separate cars C-1 and C-2 from restrained cars C-3 and C-4. In Step F, the car positioner operator automatically uncouples the car positioner device from car C-1 and, in Step G, moves the car positioning device a distance from car C-1 to permit free pivoting of the car positioner arm to a vertical position, as shown in Step H. The car positioning device is then returned to a position between separated cars C-2 and C-3, Step I, and the car positioner arm is pivoted to a horizontal position between those separated cars, Step J. The car positioner arm of the car positioner device is coupled to car C-3 and moved towards car C-2, pulling cars C-3 and C-4 therewith, after release of the clamps, as shown in Step K. In Step L, the car positioner pulls cars C-3 and C-4 towards the car dumper while bumping cars C-1 and C-2 into the rotary dumper. When the loaded cars C-1 and C-2 roll onto the dumper after being bumped, they are stopped by a wheel braking mechanism called a retarder when they have reached the desired position. While the cars C-1 and C-2 are being dumped, the cars C-3 and C-4 are moved towards the dumper, Step N (corresponding to Step E) and the sequence is repeated. The retarders that are used to stop cars after they have rolled into the dumper are costly to mount and difficult to maintain. The method of spotting cars on the dumper in this system requires considerable skill and cars are often misspotted.

Referring now to FIG. 2, the unloading of random size cars in pairs, with a pair of cars dumped simultaneously, is illustrated wherein a C-shaped dumper end ring is used so as to permit entrance of a charger arm in the dumper for direct positioning of the cars to be dumped. In Step A, the clamps holding the cars are released after coupling of a car positioner device to the lead car C-1, while a car charging device is at rest position adjacent the double car dumper. The car positioner device moves the cars C-1 to C-4 so as to position car C-1 at the car charging device, Step B, and the clamps are activated to contact and restrain the remaining cars, cars C-3 and C-4 (Step C). The car positioner arm of the car positioner device is then uncoupled from the lead car C-1 (Step D) and the arm retracted to a vertical position while the car charger arm of the car charger is lowered (Step E). After coupling the car charger arm to the lead car C-1, the cars to be dumped, C-1 and C-2, are uncoupled from the remaining cars and, while the uncoupled cars C-1 and C-2 are being moved towards the car dumper, the car positioner device is returned for the next sequence, (Step F). The car charging device is specially designed so that it will pass through the C-shaped dumper schematically illustrated in FIG. 3, which illustrates the dumper d of C-shaped design to permit access of the charging device c, pulling the cars C-1 and C-2 into the dumper to spot the same for the dumping cycle, as illustrated in Steps G and H. In Step I, the car charging device is uncoupled from car C-1 while the car positioning device is moved towards C-3 for coupling. The cars C-1 and C-2 are dumped in Step J, while the charging arm of the car charging device is raised and the car charging device is returned to its rest position, and the clamps are released to permit movement of the subsequent cars C-3 and C-4 by the car towards the car charging device in Step K while the dumper returns to its normal position. In Step L (corresponding to Step B) the cars to be dumped next, C-3 and C-4, have been positioned for receipt by the car charging device, while subsequent cars are being restrained by the clamps for a repeat of the above sequence. This operation requires the use of a specially designed dumper end ring of C-shaped design as illustrated in FIG. 3, which is expensive and, due to its lack of symmetry, requires the use of a car clamping mechanism which must reach over the top of the cars to be emptied. This type of clamp tends to restrict the flow of material from the car and can be especially troublesome when handling frozen coal. The maximum dumping rotation of the C-shaped dumper also is often limited to less than 180°, which can be unacceptable for dumping sticky material. This system also requires a car charging device in addition to the car positioning device with the resultant added cost and maintenance.

In the present invention, means are provided for fully controlling the positioning of random cars on a rotary car dumper without the expense of C-shaped dumper end rings and without the need for a second car handling device, the car charging device, such as described in FIG. 2, while the means also avoids the problems associated with the dumper mounted retarders used in the system described in FIG. 1.

Figure 4:
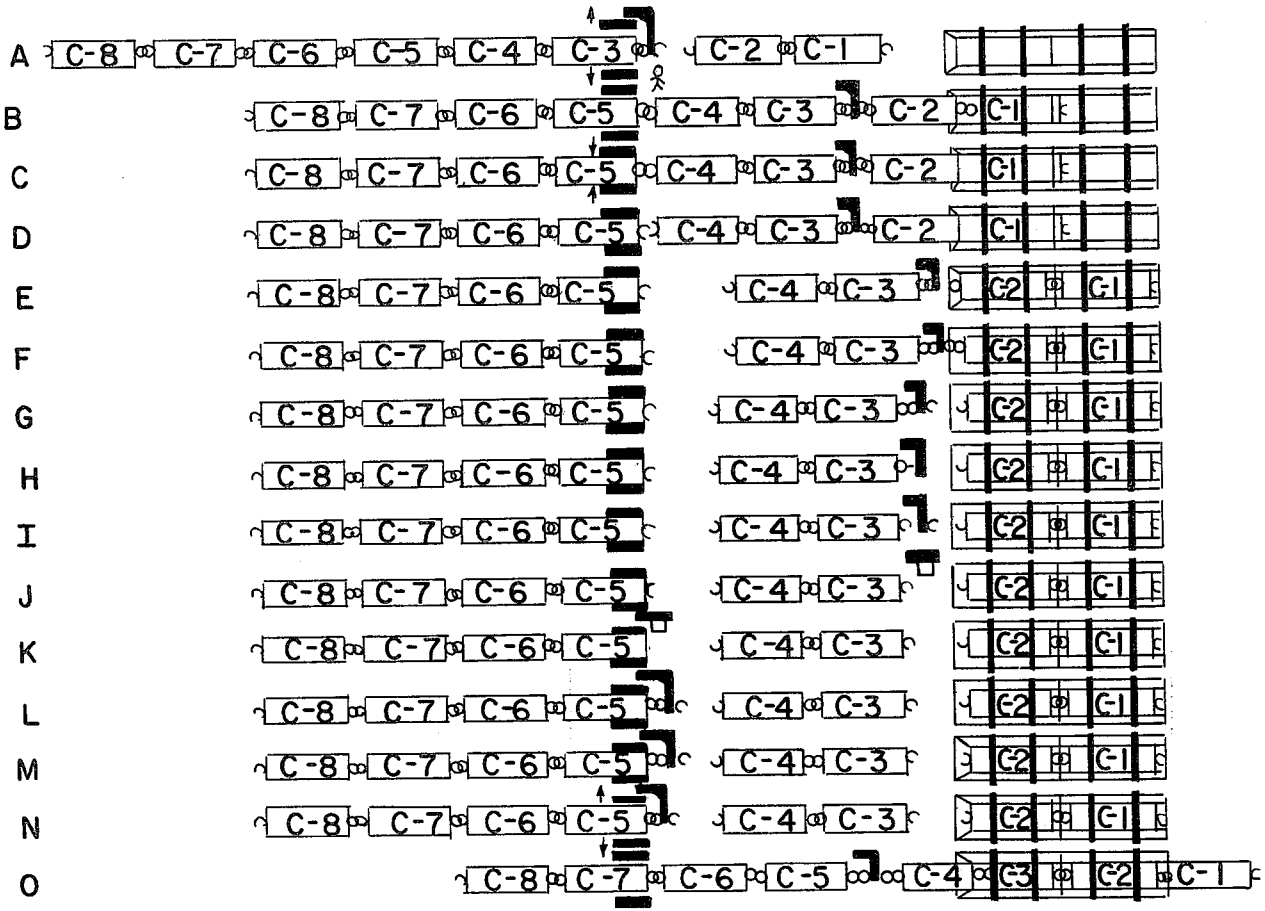
FIG. 4 schematically illustrates a method according to the present invention wherein the car positioner device is usable to precisely position a car within the conventional rotary dumper.

FIG. 4 illustrates schematically the sequence used in the present invention for positioning random cars to be dumped in a car dumper without the need for rolling the cars into the dumper and without the need for a C-shaped dumper ring design. The present apparatus uses a cantilevered arm on the train positioning device having forward and aft couplers thereon. The arm is mounted to the positioner carriage in a manner which enables the positioner arm's forward coupler to reach into the confines of the car dumper to control and exactly position the cars to be dumped, enabling a high degree of automation in dumping random cars.

As illustrated in FIG. 4, a train of cars C-1 to C-8 is advanced towards the car dumper two car lengths, using the aft coupler of the train positioning device. The clamps are then activated to hold car C-3 and subsequent cars in place. The cars to be dumped, C-1 and C-2, are uncoupled from the subsequent cars and are advanced leaving about a 10-foot gap between car C-2 and the subsequent cars. The car positioner is uncoupled from car C-1 and returned to the clamp area where the arm of the car positioner is lowered into the gap and the aft coupler of the car positioning device is coupled to the forward coupler of car C-3. The clamps in Step A are released from engagement with car C-3.

A single operator is present who controls the car positioning device and is also available to uncouple subsequent cars. The car positioner device, in Step B, is, after coupling of the aft coupler with the lead coupler of car C-3, moved towards the two cars C-1 and C-2, and the forward coupler of the car positioning device is coupled with the trailing coupler of the car C-2. Continued movement urges the cars C-1 and C-2 partially into the car dumper, until car C-5 is positioned intermediate the clamps. The clamps are activated to restrain car C-5 and the subsequent cars, Step C, and car C-4 is uncoupled from car C-5, Step D. Cars C-1 to C-4 are then moved towards the car dumper by the car positioning device, until the lead cars, C-1 and C-2, are properly positioned within the dumper, Step E, and, after precise positioning, the forward coupler of the car positioning device is uncoupled from the trailing coupler of car C-2, Step F. The car positioner, with the aft coupler still coupled to car C-3, is jogged slowly away from the car dumper to move cars C-3 and C-4 to a position intermediate the car dumper and the clamps, Step G. The car positioner aft coupler is then uncoupled from the lead coupler of car C-3, Step H, and advanced forward slightly, Step I. The arm of the car positioner is raised to the vertical position, Step J, for return of the positioner to the position adjacent the clamps, Step K. After lowering of the arm, Step L, the aft coupler of the car positioner arm is coupled with the lead coupler of car C-5, Step M. The clamps are then released from restraining position in Step N (corresponding to Step A) and in Step O (corresponding to Step B), the car positioner device, with the aft coupler coupled to the lead coupler of the car C-5, is moved towards car C-4 where the forward coupler of the positioner arm is coupled with the trailing coupler of car C-4 and the sequence repeated.

Figure 5:
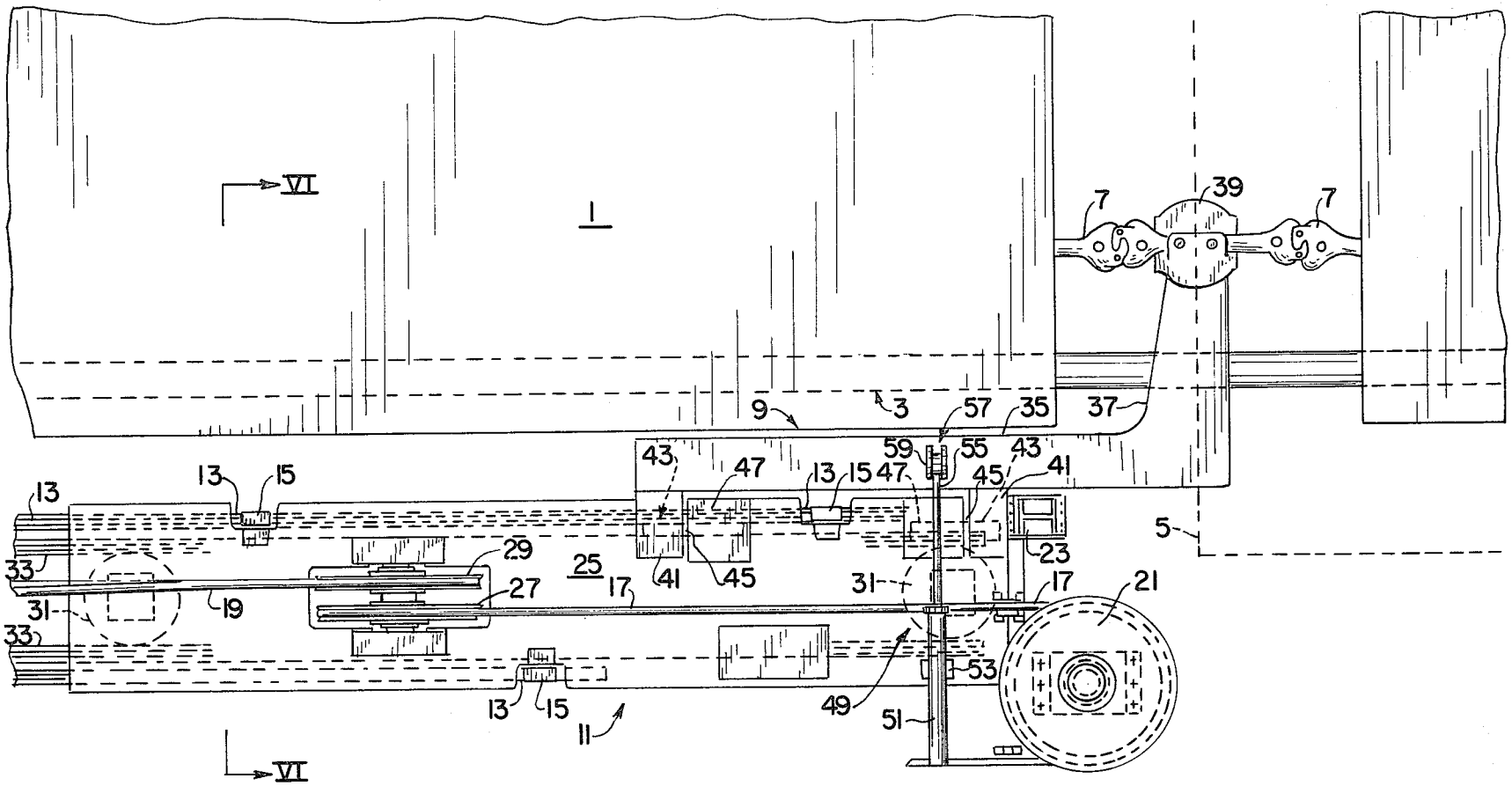
FIG. 5 is a top plan view of the car positioner carriage and positioner arm of the railroad car positioning apparatus of the present invention in its furthest extent of travel in the direction of a car dumping apparatus.
Figure 6:
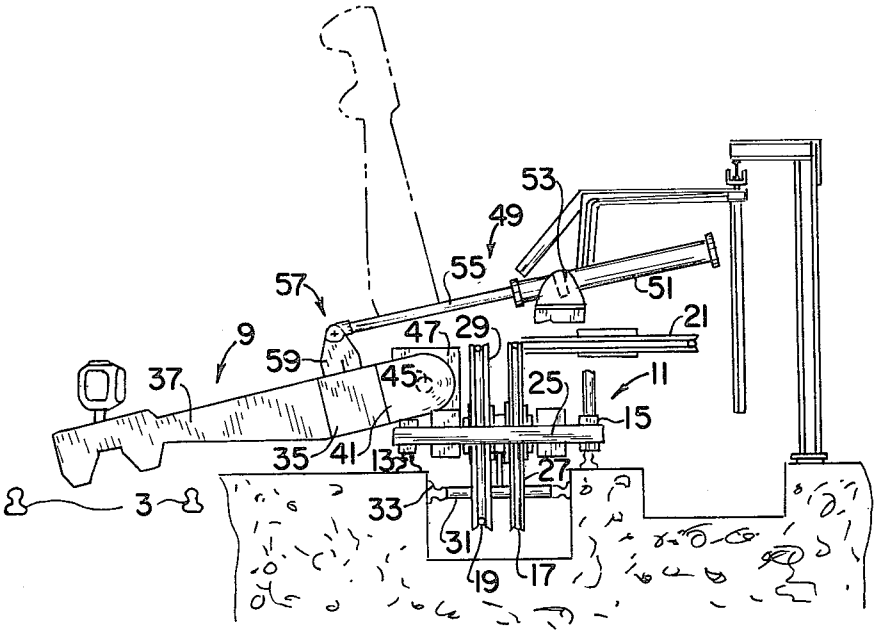
FIG. 6 is a cross sectional view of the car positioner device taken along the lines of V1—VI of FIG. 5.

Referring now to FIGS. 5 and 6, there is shown in general arrangement, an apparatus in accordance with the present invention. A railroad car 1, represents a random car, carried by track 3, for placement into a rotary dumper apparatus 5, the end of the car dumper only designated by dash lines. The rotary car dumper 5 may be of conventional design such as is commonly used for dumping a single car, or a pair of cars simultaneously, and empties the car by revolving the car. The coupling 7 of the car 1 may be of conventional design, since the car 1 is positioned precisely in the car dumper 5 by the present apparatus and may be uncoupled from any succeeding cars. Thus, the present apparatus is especially suited for use in random car dumping.

The car 1 is positioned within the rotary car dumper 5 by a car positioning arm 9 pivotally mounted on a travelling carriage 11. The carriage 11 is adapted for movement along a trackway 13, such as by use of wheels 15. The trackway 13 along which the carriage 11 travels is disposed parallel to the railroad tracks 3. In order to permit the use of the carriage in placement of a car or cars into the rotary dumper, the carriage trackway 13 should be of length in excess of that necessary to enable movement of the carriage the distance needed to move two cars into the rotary dumper. The trackway 13 may be supported by pedestals or other suitable supports.

The carriage 11 is movable along the trackway 13 by the use of advancing cables 17 and retracting cables 19. The advancing cables are reaved around a head sheave 21. The retracting cables 17 are reaved through an adjustable tail sheave, with the tail sheave (coacting) with a conventional cable winding drum, which is powered by a motor or the like, all of which are conventional and not shown in the drawing. Bumpers are also employed at both ends of travel of the carriage 11 along the trackway 12, with only the bumper 23 adjacent the head sheave 19 shown in the drawings. While the preferred system illustrated uses sheaves and cables to guide the carriage, other means such as rack and pinion or hydraulic means may, of course, also be used.

The carriage 11 has a support base 25 which has mounted thereon an advancing sheave 27 and a retracting sheave 29 which cooperate with the advancing cables 17 and retracting cables 19. The sheaves are preferrably positioned side by side and both the advancing sheave 27 and retracting sheave 29 are preferrably positioned behind the midpoint taken along the length of the carriage 11 between the midpoint of the carriage support base 25 and the trailing end thereof. In addition to the wheels 15 which travel along carriage trackway 13, horizontal stabilizing wheels 31 are provided which travel along trackways 33, which stabilizer wheels 31 counteract the large moments imposed upon the carriage base 25 upon imposition of a load at the end of the car positioning arm 9.

Pivotally mounted on the carriage support base 25 is the car positioning arm 9 which arm is of L-shaped configuration having a stem or long section 35 and a leg or short section 37. The long section 35 of the L-shaped car positioning arm 9 extends in the direction of the tracks 3, while the short section 37 carries, at the distal extremity thereof an apparatus 39 for engagement with the coupler of a railroad car or couplers of two adjacent rail cars. The apparatus 39 is preferably the force transferring means described in U.S. Pat. No. 3,942,451, assigned to the assignee of the present invention, the contents of which are incororated by reference herein.

The car positioning arm 9 is pivotally mounted on the carriage support base 25 by extensions or leaves 41 which extend laterally from the long section 35 of the car positioning arm 9, to support confronting pivot pins 45 axially aligned in the plane of the long section 35. The free ends of the pivot pins 45 are journaled for rotation in bearing blocks 47 affixed to the carriage support base 25. The car positioning arm 9 is thus pivotable in a vertical plane relative to the carriage support base 25. Pivotal movement of the car positioning arm 9 is effected by use of means such as fluid driven piston rod and cylinder unit 49. With a hydraulic cylinder apparatus 51, pivotally affixed by means of brackets 53, to the carriage support base 25, and having a piston rod 55 pivotally connected at 57 to the long section 35 of the car positioning arm 9, between brackets 59, attached to the long section 35, the extension and retraction of the piston rod 55 will pivotally lower or raise the car positioning arm 9.

As described above, the car positioning arm 9 is pivoted to a position in substantial planar relationship to the carriage support base 25. With such positioning, the short section 37 of the car positioner arm is able to advance past the head sheave 21 and extend into the car dumper 5. This extension of the short section 37 with the coupler apparatus 39 thereon enables direct and precise placement of a railroad car within the confines of the car dumper.

It is to be understood that the present invention is usable for single dumping of railroad cars, wherein individual cars are moved by the apparatus described, as well as for dumping of pairs of cars, wherein pairs of cars are positioned by the car positioning device.

We claim:

1. A method for positioning railroad cars to be dumped in a rotary car dumper by the use of a car positioning device having an arm thereon with forward and aft couplers, where the railroad cars each have a lead coupler and a trailing coupler thereon which may be coupled to said forward and aft couplers, wherein there is a space provided between restraining means for the railroad cars and the rotary dumper, comprising:

(a) positioning a first railroad car in the space between the restraining means and the dumper;

(b) coupling the aft coupler of the car positioner with the lead coupler of a second railroad car restrained by the restraining means;

(c) releasing the restraining means and moving the car positioner towards the car dumper pulling the second railroad car therewith;

(d) coupling the forward coupler of the car positioner with the trailing coupler of the first railroad car and moving the first railroad car towards the dumper;

(e) engaging the restraining means to restrain a third railroad car;

(f) uncoupling the trailing coupler of the second railroad car from the third railroad car;

(g) moving the positioner further towards the dumper and positioning the first car in the dumper solely by use of the car positioner;

(h) uncoupling the forward coupler of the car positioner from the trailing coupler of the first railroad car;

(i) moving the car positioner and second railroad car to a position spaced from the car dumper and the restraining means;

(j) uncoupling the aft coupler of the car positioner from the leading coupler of the second railroad car;

(k) returning the car positioner to a position between the third railroad car and the second railroad car; and (l) repeating the steps of b-k.

2. The method as defined in claim 1 wherein said railroad cars are dumped in pairs and wherein a first, second and third pair of railroad cars is substituted for said first, second and third railroad car.

3. The method as defined in claims 1 or 2 wherein said first railroad car or pair of cars is moved at least partially into the dumper in Step (d).

4. The method as defined in claims 1 or 2 wherein said first car or pair of cars is positioned in the dumper in Step (g) by the car positioner arm with the remainder of the car positioning device spaced from the dumper.

* * * * *